US009975331B2

(12) United States Patent
Kato et al.

(10) Patent No.: US 9,975,331 B2
(45) Date of Patent: May 22, 2018

(54) INKJET PRINTER PROVIDED WITH DIAPHRAGM AND ADJUSTING METHOD THEREFOR

(71) Applicant: Brother Kogyo Kabushiki Kaisha, Nagoya-shi, Aichi-ken (JP)

(72) Inventors: Yasuo Kato, Chita-gun (JP); Toru Kakiuchi, Chita-gun (JP); Yuichi Ito, Mie-gun (JP); Tomoko Hibino, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/086,552

(22) Filed: Mar. 31, 2016

(65) Prior Publication Data

US 2017/0087825 A1 Mar. 30, 2017

(30) Foreign Application Priority Data

Sep. 30, 2015 (JP) ..... 2015-193741

(51) Int. Cl.
*B41J 2/045* (2006.01)

(52) U.S. Cl.
CPC ..... *B41J 2/04541* (2013.01); *B41J 2/0459* (2013.01); *B41J 2/04558* (2013.01); *B41J 2/04581* (2013.01); *B41J 2/04588* (2013.01)

(58) Field of Classification Search
None
See application file for complete search history.

(56) References Cited

U.S. PATENT DOCUMENTS

| | | | | |
|---|---|---|---|---|
| 6,189,992 | B1 * | 2/2001 | Suzuki | B41J 2/04505 347/14 |
| 6,193,342 | B1 | 2/2001 | Suzuki | |
| 9,139,000 | B2 | 9/2015 | Hirai | |
| 2007/0200885 | A1 | 8/2007 | Hibi | |
| 2008/0129769 | A1 | 6/2008 | Kim | |
| 2011/0061216 | A1 | 3/2011 | Yamada et al. | |

(Continued)

FOREIGN PATENT DOCUMENTS

| | | | |
|---|---|---|---|
| EP | 0728583 | A2 | 8/1996 |
| EP | 1055517 | A2 | 11/2000 |

(Continued)

OTHER PUBLICATIONS

Feb. 13, 2017—(EP) Extended Search Report—App 16162977.9.

*Primary Examiner* — Lisa M Solomon
(74) *Attorney, Agent, or Firm* — Banner & Witcoff, Ltd.

(57) ABSTRACT

An inkjet printer comprising a plurality of nozzles, a plurality of pressure chambers, a plurality of diaphragms, a plurality of piezoelectric elements, and a controller. Each of the plurality of diaphragms is deflected between a first state and a second state. The controller is configured to control voltage application to each of the plurality of piezoelectric elements. When a diaphragm is in the first state, the controller applies a first voltage so that the diaphragm is substantially flat; and when the diaphragm is in the second state, the controller applies a second voltage. The controller is configured to control the voltage such that a pressure chamber ejects an ink droplet from the corresponding nozzle in response to the deflection of the diaphragm reverting from the second state to the first state.

13 Claims, 6 Drawing Sheets

(56) References Cited

U.S. PATENT DOCUMENTS

| | | | | |
|---|---|---|---|---|
| 2011/0063348 | A1 | 3/2011 | Mita | |
| 2012/0001970 | A1* | 1/2012 | Satoh | B41J 2/04581 347/10 |
| 2012/0007906 | A1 | 1/2012 | Zhang | |
| 2014/0015902 | A1* | 1/2014 | Hayashi | B41J 2/04581 347/68 |
| 2014/0263727 | A1 | 9/2014 | Hirai | |

FOREIGN PATENT DOCUMENTS

| | | | |
|---|---|---|---|
| JP | 2002-225291 | A | 8/2002 |
| JP | 2013-151073 | A | 8/2013 |
| JP | 2014-176986 | A | 9/2014 |

* cited by examiner

INKJET PRINTER PROVIDED WITH DIAPHRAGM AND ADJUSTING METHOD THEREFOR

CROSS REFERENCE TO RELATED APPLICATION

This application claims priority from Japanese Patent Application No. 2015-193741 filed Sep. 30, 2015. The entire content of the priority application is incorporated herein by reference.

TECHNICAL FIELD

The present disclosure relates to an inkjet printer provided with a diaphragm and an adjusting method therefor.

BACKGROUND

Conventionally, inkjet printers have ejected ink from nozzles in communication with respective pressure chambers using piezoelectric elements to vibrate diaphragms covering the pressure chambers in order to change the pressure in the pressure chambers. One such inkjet printer known in the art also adjusts the initial deflection positions of these diaphragms.

The liquid jet unit of this conventional inkjet printer is provided with piezoelectric elements for applying pressure to the pressure chambers through the diaphragms, and a sealed space accommodating the piezoelectric elements. The pressure in the sealed space is adjusted so that the deflection of the diaphragm when voltage is applied to the corresponding piezoelectric element is symmetrical about a reference plane to the deflection of the diaphragm when voltage is not applied to the piezoelectric element.

SUMMARY

However, deflection of diaphragms produces crosstalk between neighboring pressure chambers in the liquid jet unit of the conventional inkjet printer described above, resulting in lower image quality. Specifically, in a printing operation performed on a device provided with a plurality of pressure chambers arranged in rows and separated by partitions, the device deflects the diaphragms individually based on print data to exert pressure on the corresponding pressure chambers. If pressure is exerted on one pressure chamber but not on a neighboring pressure chamber, the diaphragm covering the first pressure chamber deflects into the pressure chamber, while the diaphragm covering the neighboring pressure chamber does not deflect. As a consequence, the partition between the neighboring pressure chambers leans into the first pressure chamber, causing the diaphragm covering that chamber to be displaced further into the chamber.

On the other hand, if pressure is applied to two neighboring pressure chambers, both diaphragms of these pressure chambers are deflected. As a result, the two neighboring diaphragms pull against each other, making it unlikely that the partition between the neighboring pressure chambers will lean to either side. Accordingly, there is less displacement in the diaphragms caused by tilting of the partition when pressure is exerted on both of the neighboring pressure chambers.

Thus, displacement of a diaphragm includes displacement caused by deformation of the piezoelectric element and displacement caused by tilting of the neighboring partition. As described above, displacement of the diaphragm is smaller when pressure is also applied to a neighboring pressure chamber than when pressure is not applied to neighboring pressure chambers. Variation in the displacement of diaphragms caused by such crosstalk causes a fluctuation in the velocity of ink ejected from the nozzles, leading to a decline in the quality of images printed with the ejected ink droplets.

In the liquid jet unit of the conventional inkjet printer, deflection of the diaphragm is adjusted by varying the pressure in the sealed space, necessitating both a complex configuration and complex control.

It is therefore an object of the disclosure to provide an inkjet printer capable of reducing variation in the displacement of diaphragms caused by crosstalk through a simple construction. It is another object of the present invention to provide a method of adjusting the deflection of diaphragms in the inkjet printer.

According to one aspect, an inkjet printer includes a plurality of nozzles, a plurality of pressure chambers, a plurality of diaphragms, a plurality of piezoelectric elements, and a controller. The plurality of pressure chambers are in fluid communication with respective ones of the plurality of nozzles individually. The plurality of diaphragms are attached to respective ones of the plurality of pressure chambers individually. Each of the plurality of diaphragms is deflected between a first state in which corresponding pressure chamber has a first volume and a second state in which the corresponding pressure chamber has a second volume different from the first volume. The controller is configured to control voltage application to each of the plurality of piezoelectric elements. When a diaphragm is in the first state, the controller applies a first voltage so that the diaphragm is substantially flat; and when the diaphragm is in the second state, the controller applies a second voltage. The controller is configured to control the voltage such that a pressure chamber ejects an ink droplet from the corresponding nozzle in response to the deflection of the diaphragm reverting from the second state to the first state.

According to another aspect, an adjusting method for inkjet printer including a nozzle, a pressure chamber in fluid communication with the nozzle, a diaphragm, a piezoelectric element, and a controller. The diaphragm is attached to the pressure chamber. The diaphragm is deflected between a first state in which the pressure chamber has a first volume and a second state in which the pressure chamber has a second volume different from the first volume. The piezoelectric element is attached to the diaphragm. The piezoelectric element is configured to deflect the diaphragm in response to a voltage applied to the piezoelectric element. The adjusting method includes: applying the piezoelectric element a first voltage such that the pressure chamber has the first volume, changing the voltage applied to the piezoelectric element from the first voltage to a second voltage such that the pressure chamber has the second volume, changing the voltage applied to the piezoelectric element from the second voltage to the first voltage, measuring an impact position of ink ejected from the nozzle; and adjusting the first voltage such that the impact position is the same as an impact position which can be achieved by an ink droplet ejected from the pressure chamber with the diaphragm that, when being in the first state, is flattened.

According to another aspect, an adjusting method for inkjet printer including a nozzle, a pressure chamber in fluid communication with the nozzle, a diaphragm, a piezoelectric element, and a controller. The diaphragm is attached to the pressure chamber. The diaphragm is deflected between a first state in which the pressure chamber has a first volume and a second state in which the pressure chamber has a second volume different from the first volume. The piezoelectric element is attached to the diaphragm. The piezoelectric element is configured to deflect the diaphragm in response to a voltage applied to the piezoelectric element. The adjusting method includes: applying a first voltage to the a piezoelectric element so that the pressure chamber has the first volume, changing the voltage applied to the piezoelectric element from the first voltage to a second voltage so that the pressure chamber has the second volume different from the first volume, changing the voltage applied to the piezoelectric element from the second voltage to the first voltage, and adjusting the first voltage such that the measured distance is the same as a distance to the diaphragm that is flattened.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
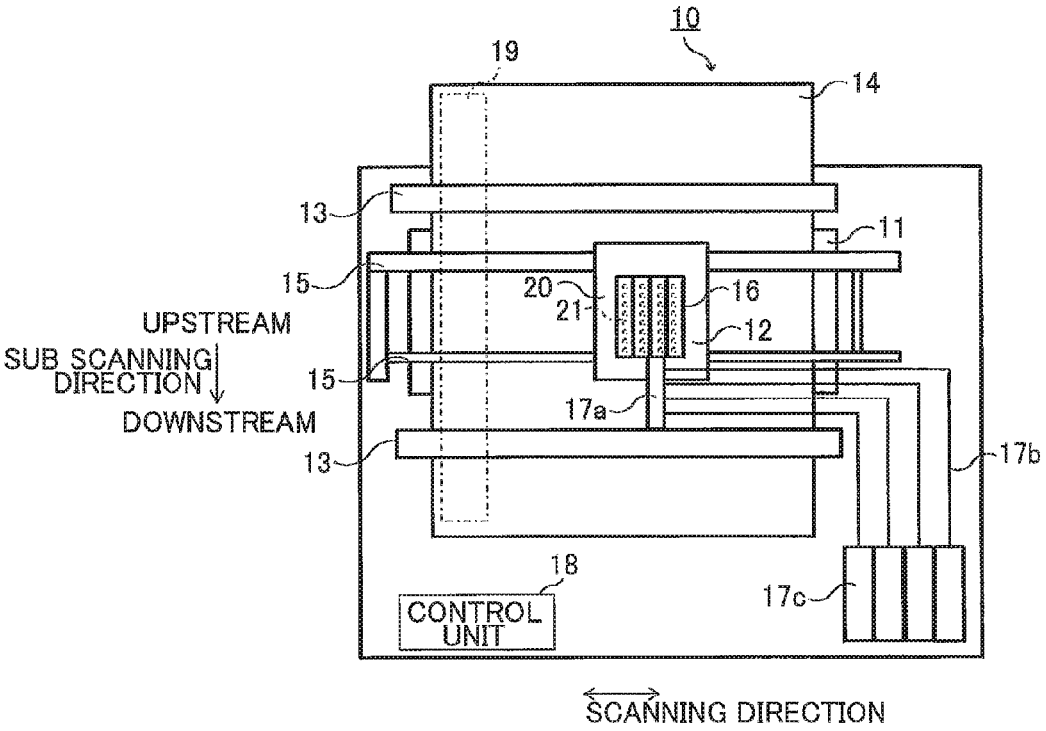
FIG. 1 is a schematic diagram of an inkjet recording apparatus according to a first embodiment.

An inkjet recording apparatus according to a first embodiment will be described while referring to the accompanying drawings wherein like parts and components are designated by the same reference numerals to avoid duplicating description.

First, the structure of an inkjet printer 10 as an example of an inkjet recording apparatus will be described with reference to FIG. 1. FIG. 1 is a schematic diagram of the inkjet printer 10 according to the first embodiment. The inkjet printer 10 includes a print head 20, and a control unit 18. The inkjet printer 10 may be further provided with a sheet-feeding mechanism (not shown), a platen 11, a carriage 12, and a conveying mechanism 13. The control unit 18 is an example of a controller.

The sheet-feeding mechanism supplies sheets 14 from a paper tray (not shown) onto a conveying path. The platen 11 is a base for supporting the sheets 14 supplied by the sheet-feeding mechanism.

The carriage 12 is a conveying unit that holds the print head 20 while reciprocating in a scanning direction. The carriage 12 is supported on two guide rails 15 that extend in the scanning direction and reciprocates in the scanning direction along the guide rails 15. The carriage 12 is disposed above the platen 11 and moves parallel to the platen 11 within a recording region while remaining separated from the platen 11.

Four sub tanks 16 are also supported in the carriage 12. The sub tanks 16 are juxtaposed in the scanning direction and are connected to a tube joint 17*a*. The sub tanks 16 are connected to corresponding ink cartridges 17*c* through flexible tubes 17*b* connected via the tube joint 17*a*. The four ink cartridges 17*c* store ink in the respective colors magenta, cyan, yellow, and black, for example.

The print head 20 has nozzles 21 formed therein for ejecting ink or other liquid. The print head 20 is mounted on the bottom of the carriage 12, with the nozzles 21 opposing the platen 11 in the recording region. The nozzles 21 form nozzle rows that extend in the conveying direction orthogonal to the scanning direction and are juxtaposed in the scanning direction. In the preferred embodiment, the nozzles form four rows of nozzles. The print head 20 will be described later in greater detail.

The conveying mechanism 13 receives sheets 14 supplied from the paper tray and conveys the sheets to a discharge tray (not shown) along a path that passes between the platen 11 and print head 20. The conveying direction of the conveying mechanism 13 is orthogonal to the scanning direction. In the preferred embodiment, the conveying mechanism 13 includes two conveying rollers. These conveying rollers are disposed one on the upstream side of the carriage 12 and one on the downstream side of the carriage 12 relative to the conveying direction. The conveying rollers rotate in the conveying direction about axes extending in the scanning direction.

The control unit 18 has a processing unit and a storage unit, both not shown. The processing unit is configured of a processor and the like, while the storage unit is memory that can be accessed by the processing unit. The processing unit executes programs stored in the storage unit to control the components of the inkjet printer 10. For example, the control unit 18 controls the voltages applied to piezoelectric elements in the print head 20 (see FIG. 2).

Next, a printing operation of the inkjet printer 10 will be described with reference to FIG. 1. The control unit 18 executes the printing operation. During the printing operation, the sheet-feeding mechanism supplies a sheet 14 from the paper tray onto the platen 11, and the conveying mechanism 13 intermittently conveys the sheet 14 further in the conveying direction. The print head 20 ejects ink droplets toward the sheet 14 from the nozzles 21 while being moved by the carriage 12 in the scanning direction. By ejecting ink droplets based on image data, a desired image can be printed on the sheet 14.

Figure 2:
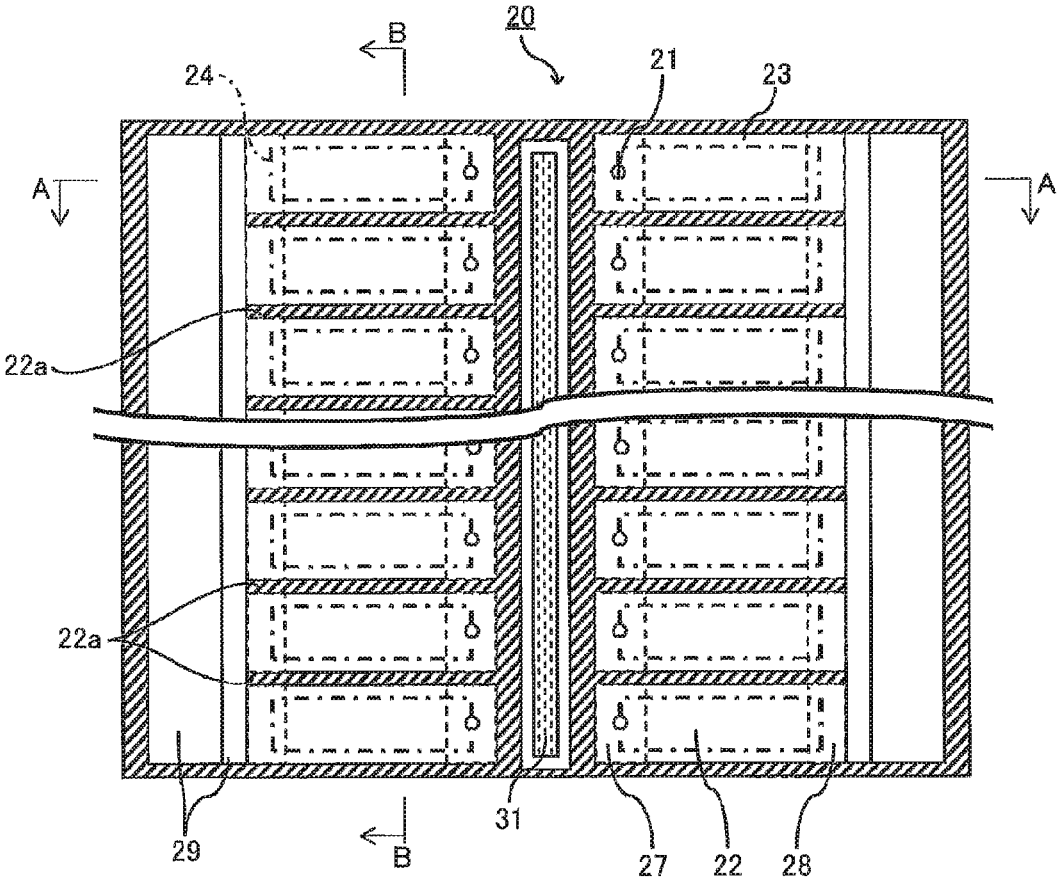
FIG. 2 illustrates a print head viewed from a case of the inkjet recording apparatus according to the first embodiment.
Figure 3:
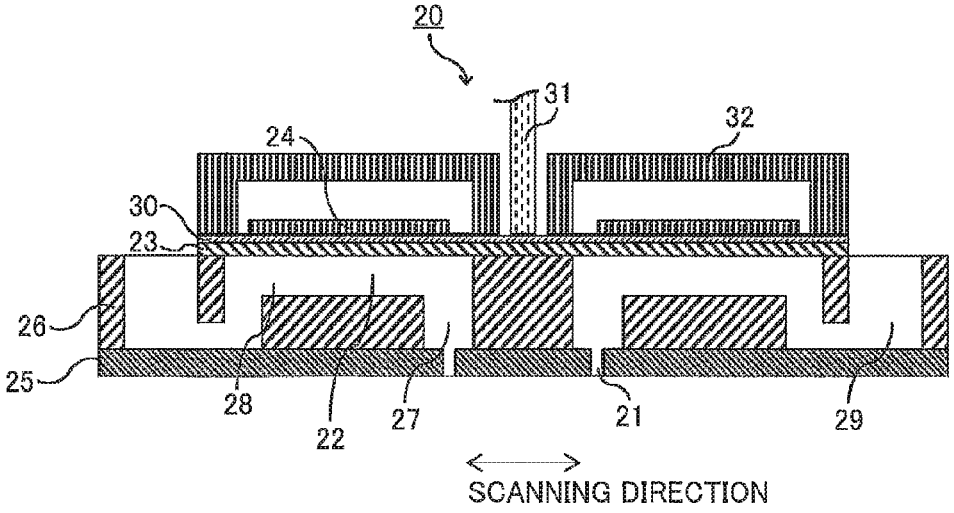
FIG. 3 is a cross-sectional view of the print head taken along a line A-A of FIG. 2.
Figure 4:
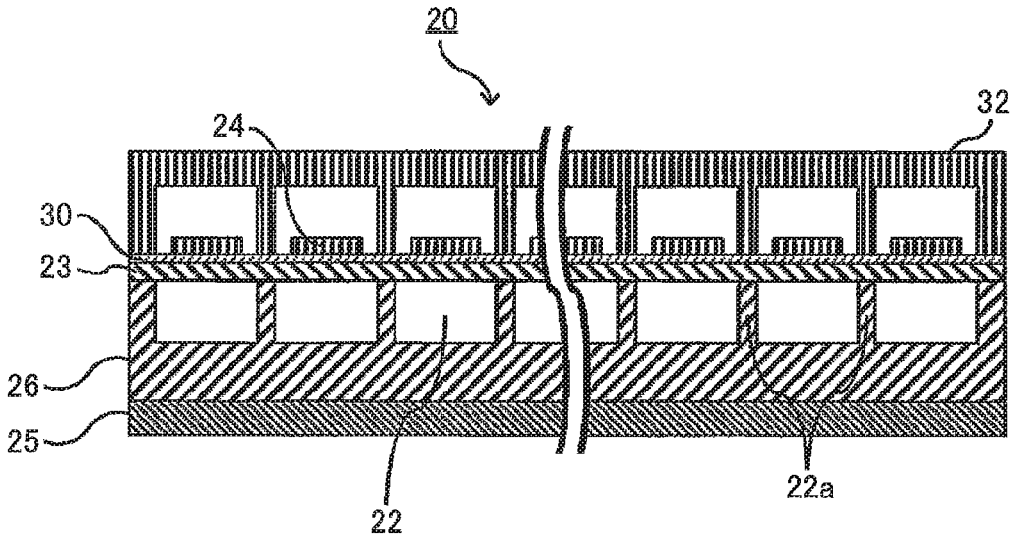
FIG. 4 is a cross-sectional view of the print head taken along a line B-B in FIG. 2.

Next, the structure of the print head 20 will be described with reference to FIGS. 2 through 4. FIG. 2 is a plan view of the print head 20. FIG. 3 is a cross-sectional view of the print head 20 taken along the line A-A in FIG. 2. FIG. 4 is a cross-sectional view of the print head 20 taken along the line B-B in FIG. 2. Note that some of the structural components have been omitted in FIG. 2 to facilitate understanding.

The print head 20 includes pluralities of the nozzles 21, pressure chambers 22, diaphragms 23, and piezoelectric elements 24. The print head 20 is formed by sequentially stacking a first plate 25, a second plate 26, and the diaphragm 23. Hereinafter, the direction in which the first plate 25, second plate 26, and diaphragm 23 are sequentially stacked will be called the stacking direction.

The first plate 25 is a flat plate in which the nozzles 21 are formed. The bottom surface of the first plate 25 serves as the nozzle surface. Nozzle holes constituting the nozzles are formed in this nozzle surface. The nozzles 21 have a cylindrical shape and penetrate the first plate 25 in its thickness direction from its top surface to its bottom surface. The nozzles 21 are arranged in rows such that the resolution of ink ejected from the nozzles 21 is at least 300 dpi.

The second plate 26 is a flat plate in which is formed with descenders 27, the pressure chambers 22, narrow channels 28, and manifolds 29. The bottom surface of the second plate 26 is bonded to the top surface of the first plate 25.

The descenders 27 are through-holes that penetrate the first plate 25 from the top surface to the bottom surface. One end of each descender 27 is in communication with a corresponding nozzle 21, while the other end is in communication with a corresponding pressure chamber 22. The pressure chambers 22 are rectangular parallelepiped-shaped chambers that are longer in the scanning direction than the conveying direction. The pressure chambers 22 are aligned in the conveying direction, with partitions 22*a* respectively interposed between neighboring pressure chambers 22. Hereinafter, the direction in which the pressure chambers 22 are aligned with the interposed partitions 22*a* will be called the aligned direction of the pressure chambers 22. Further, when the pressure chambers 22 aligned in the conveying direction are arranged in two rows juxtaposed in the scanning direction, as in the preferred embodiment, the direction in which neighboring pressure chambers 22 separated by thin walls are aligned will be called the aligned direction. In the preferred embodiment, the aligned direction is the conveying direction. The pressure chambers 22 are in communication with the manifolds 29 via the narrow channels 28.

The manifolds 29 are common channels for supplying stored ink to a plurality of the pressure chambers 22. The manifolds 29 have a rectangular parallelepiped shape that is longer in the conveying direction than the scanning direction and extend across the entire length of the plurality of aligned pressure chambers 22 in the conveying direction. The bottom sides of the manifolds 29 are enclosed by the first plate 25, while the top openings of the manifolds 29 are in communication with the sub tanks 16 and the like (see FIG. 1).

Figure 5:
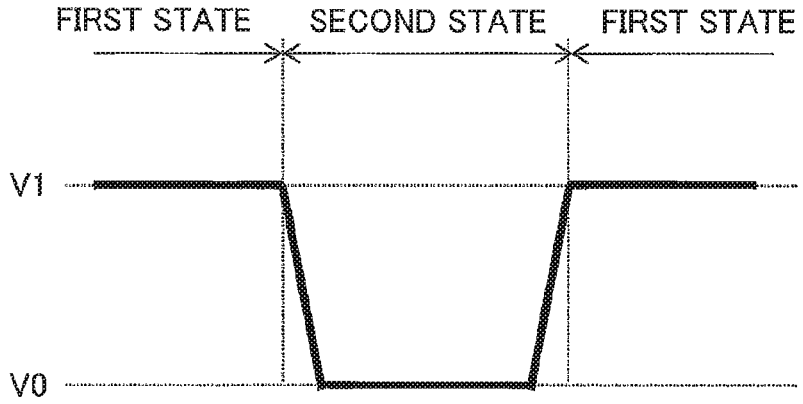
FIG. 5 is a graph illustrating voltage applied to a piezoelectric element.

The diaphragms 23 are formed of a flat plate. As illustrated in FIG. 4, each diaphragm 23 is defined as each part of the flat plate that is divided by each pressure chamber 22. The bottom surface of each diaphragm 23 is bonded to the top surface of the second plate 26. Each diaphragm 23 covers a corresponding pressure chamber 22 and serves as a wall of the pressure chamber 22. A corresponding piezoelectric element 24 is provided on the top surface of the diaphragm 23 in the area covering the pressure chamber 22. The diaphragm 23 has a flat orientation when a first voltage V1 (see FIG. 5) is applied to the piezoelectric element 24, and deflects toward either the pressure chamber 22 side or the piezoelectric element 24 side from its flat orientation when a second voltage V0 (see FIG. 5) is applied to the piezoelectric element 24. The top surfaces of the diaphragms 23 are covered by insulating layers 30.

The first voltage V1 (see FIG. 5) is a standby voltage applied to a piezoelectric element 24 when the power supply of the inkjet printer 10 is on but an ink ejection command has not been issued for the nozzle 21 corresponding to the piezoelectric element 24 (standby state; first state). The second voltage V0 (see FIG. 5) is a drive voltage applied to the piezoelectric element 24 when an ink ejection command has been issued for the nozzle 21 corresponding to the piezoelectric element 24. The second voltage V0 is set to a value lower than the first voltage V1, such as 0 V.

The piezoelectric elements 24 are arranged on top of the diaphragms 23 with the insulating layer 30 interposed therebetween and function to apply pressure to the ink in the corresponding pressure chambers 22. Each piezoelectric element 24 is configured of a pair of electrode layers and a piezoelectric layer interposed therebetween. The bottom electrode layer in the pair is disposed on top of the insulating layer 30, while the top electrode layer is connected to the control unit 18 (see FIG. 1) through an interconnect substrate 31. The piezoelectric element 24 deforms in response to a voltage applied by the control unit 18.

The interconnect substrate 31 is a flexible film-like circuit board, such as a chip-on-film (COF), on which a driver IC (not shown) is mounted. The driver IC is configured of a semiconductor chip that drives the piezoelectric elements 24. The interconnect substrate 31 is arranged between the two rows of pressure chambers 22 extending in the conveying direction in the middle of the diaphragms 23 relative to the scanning direction. The interconnect substrate 31 is connected to the control unit 18 and both layers of the piezoelectric elements 24.

Cases 32 are covers that protect the piezoelectric elements 24. Each case 32 has a top portion, side portions, and an internal space enclosed by the top and side portions, and is open on its bottom side. The case 32 covers at least a portion of the diaphragms 23, so as to accommodate the piezoelectric elements 24 in its internal space. The diaphragm 23 encloses the internal space of the case 32 from the bottom side. The bottom surfaces of the side portions constituting the case 32 are bonded to the top surfaces of the diaphragms 23 by an adhesive or the like.

Figure 6A:
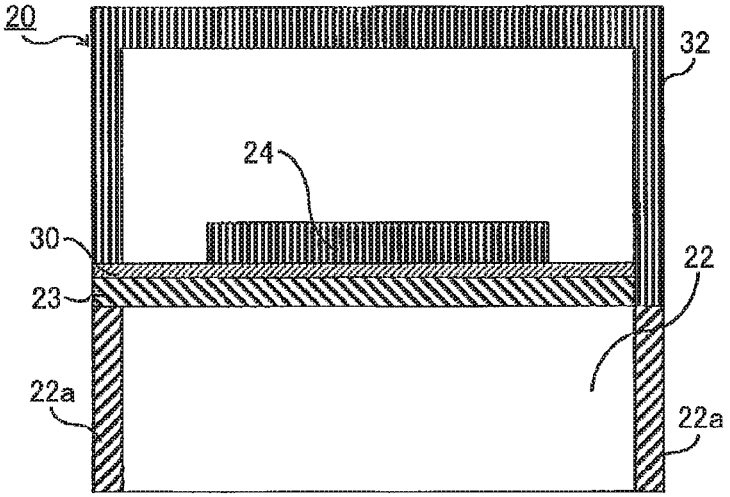
FIG. 6A is a cross-sectional view of a pressure chamber in a first state covered by a diaphragm in its flat orientation.
Figure 6B:
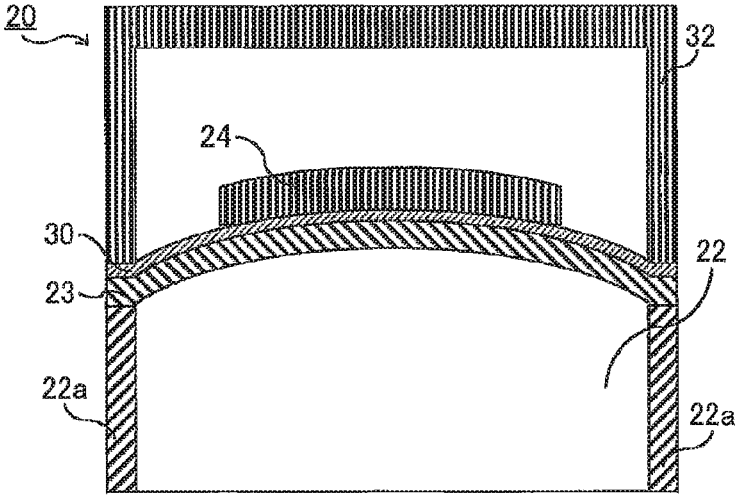
FIG. 6B is a cross-sectional view of the pressure chamber in its second state covered by the diaphragm displaced toward the piezoelectric element.
Figure 6C:
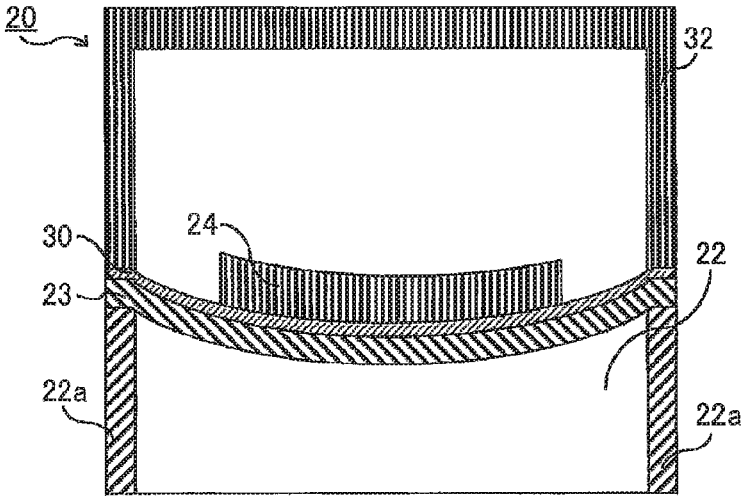
FIG. 6C is a cross-sectional view of the pressure chamber in its second state covered by the diaphragm displaced toward the pressure chamber.

Next, the ejection operations of the print head 20 will be described with reference to FIGS. 6A-6C. FIG. 6A is a cross-sectional view of a pressure chamber 22 in the first state covered by the diaphragm 23 in its flat orientation. FIG. 6B is a cross-sectional view of the pressure chamber 22 in its second state covered by the diaphragm 23 displaced toward the piezoelectric element 24 side. FIG. 6C is a cross-sectional view of the pressure chamber 22 in its second state covered by the diaphragm 23 displaced toward the pressure chamber 22 side. To rephrase this, the diaphragm 23 in the first state is in its flat orientation; the diaphragm 23 in the second state is displaced toward the piezoelectric element 24 side so that the volume of the pressure chamber 22 expands.

First, the control unit 18 (see FIG. 1) generates control signals based on print data outputted by the printer driver installed in a computer and or by a storage unit of the inkjet printer 10 or the like, and then outputs the control signals to the interconnect substrate 31 (see FIG. 2). The driver IC of the interconnect substrate 31 receives the control signals, generates drive signals for driving the piezoelectric elements 24, and outputs the drive signals to the piezoelectric elements 24.

When a piezoelectric element 24 is deformed by voltage applied by the drive signal, the corresponding diaphragm 23 is displaced so that the pressure chamber 22 changes from its first state to its second state and subsequently returns to its first state, causing ink to be ejected from the nozzle 21 during the second state. In this method, a voltage (the first voltage V1) is applied to the piezoelectric element 24 so that the diaphragm 23 in the first state is kept in a flat orientation. The first state is a state in which the pressure chamber 22 has a prescribed volume, such as the state shown in FIG. 6A. The pressure chamber 22 transitions from the first state to the second state when a voltage (the second voltage V0) is applied to the piezoelectric element 24 in response to an ink ejection command. The second state of the pressure chamber 22 has a different volume from the prescribed volume, such as a larger volume than the prescribed volume, as in the example of FIG. 6B.

Note that this description assumes that the second voltage V0 is zero volts (0 V). Hence, since a second voltage of 0 V is applied to the piezoelectric element 24 in response to an ink ejection command, it can be said that voltage is not applied to the piezoelectric element 24 in response to an ink ejection command.

That is, the diaphragm 23 is molded so as to be deflected toward the piezoelectric element 24 side in its natural state. Consequently, when a voltage is not applied to the piezoelectric element 24 and the piezoelectric element 24 is in its non-deformed state, the diaphragm 23 is deflected toward the piezoelectric element 24 side. Accordingly, the pressure chamber 22 covered by the diaphragm 23 is in its second state in which its volume is greater than the prescribed volume.

Once the printing operation has begun, the first voltage V1 is applied to a piezoelectric element 24 during wait periods before and after ink ejections in order to deform the piezoelectric element 24. When the piezoelectric element 24 deforms, the diaphragm 23 is displaced to a flat orientation. Consequently, the pressure chamber 22 covered by the diaphragm 23 is in its first state having the prescribed volume.

During ejection in which a drive signal is outputted to eject an ink droplet, the control unit 18 temporarily stops applying a voltage to the piezoelectric element 24, causing the piezoelectric element 24 to return to its non-deformed state and the diaphragm 23 to deflect toward the piezoelectric element 24 side. Consequently, the pressure chamber 22 covered by the diaphragm 23 enters its second state having a larger volume than the prescribed volume. Subsequently, the driver IC applies the first voltage V1 to the piezoelectric element 24 to deform the piezoelectric element 24, placing the diaphragm 23 back in a flat orientation. Through this operation, the pressure chamber 22 covered by the diaphragm 23 returns to the first state having the prescribed volume. Thus, since the volume of the pressure chamber 22 changes from a volume greater than the prescribed volume to the prescribed volume, pressure in the ink within the pressure chamber 22 increases, causing ink to be ejected from the corresponding nozzle 21.

Figure 7:
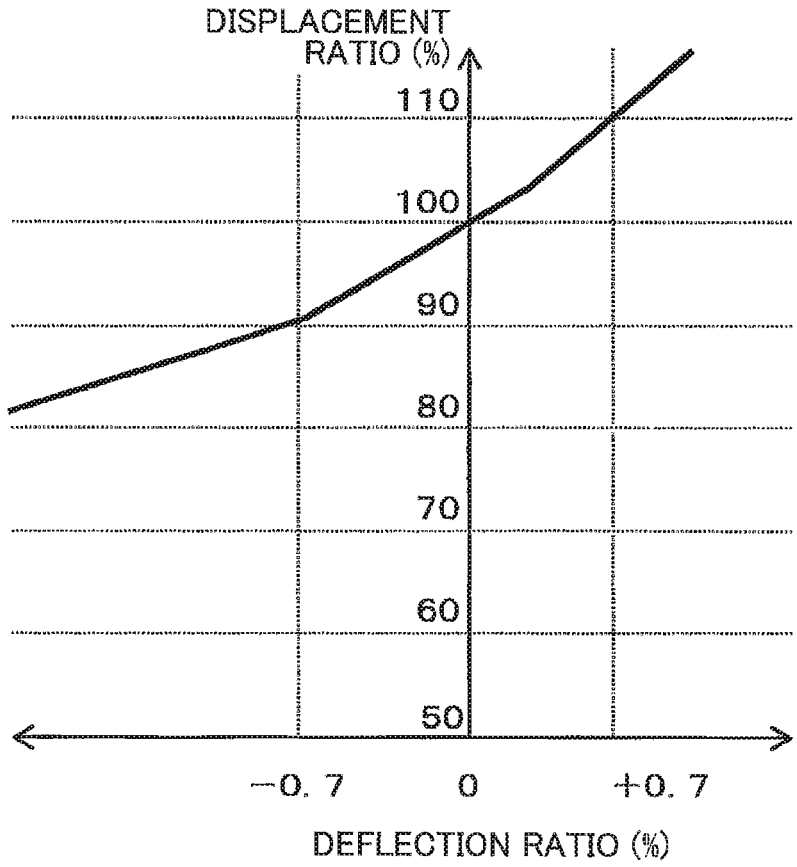
FIG. 7 is a graph representing a displacement ratio of the diaphragm relative to a deflection ratio of the diaphragm.

By setting the diaphragm 23 to a flat orientation during standby periods, this configuration can suppress variation in the displacement of the diaphragm 23 caused by crosstalk, as illustrated in FIG. 7. FIG. 7 is a graph representing the displacement ratio of the diaphragm 23 relative to the deflection ratio of the diaphragm 23.

The deflection ratio of the diaphragm 23 indicated by the horizontal axis in FIG. 7 denotes the amount of deflection in the diaphragm 23 when in its first state relative to the width of the pressure chamber 22 along the aligned direction of the pressure chambers 22. In the preferred embodiment, the width of the pressure chamber 22 is 70 micro meters (μm), and the height of the pressure chamber 22 is also 70 μm. The deflection of the diaphragm 23 is the distance between the flat diaphragm 23 in the first state and the farthest point of the diaphragm 23 deflected toward the piezoelectric element 24 side or the pressure chamber 22 side. Deflection toward the piezoelectric element 24 side will be considered positive (+), while deflection toward the pressure chamber 22 side will be considered negative (−).

The displacement ratio of the diaphragm 23 indicated by the vertical axis in FIG. 7 denotes the ratio (%) of displacement in the diaphragm 23 in the second state during multichannel ejection to the displacement of the diaphragm 23 in the second state during single-channel ejection. Here, single-channel ejection is a case in which a voltage is applied to a target piezoelectric element 24 to displace the diaphragm 23 and eject ink, while voltage is not applied to piezoelectric elements 24 neighboring the target piezoelectric element 24 so that the neighboring diaphragms 23 are not displaced. Multichannel ejection is a case in which a voltage is applied to a target piezoelectric element 24 to displace the diaphragm 23 and eject ink, while voltage is also applied to piezoelectric elements 24 neighboring the target piezoelectric element 24, causing the neighboring diaphragms 23 to be displaced. The amount of displacement in the diaphragm 23 is the farthest distance between the flat diaphragm 23 and the diaphragm 23 in the second state displaced toward the piezoelectric element 24 side or toward the pressure chamber 22 side. Displacement toward the piezoelectric element 24 side will be considered positive (+), while displacement toward the pressure chamber 22 side will be considered negative (−).

Since the diaphragm 23 is in a flat orientation during standby periods, the deflection of the diaphragm 23 is zero (0) and its deflection ratio is also zero (0). Hence, the displacement ratio of the diaphragm 23 is 100%, as indicated in FIG. 7.

In other words, displacement of the diaphragm 23 includes displacement caused by deformation of the piezoelectric element 24 and displacement caused by tilting of the partitions 22*a*. During normal single-channel ejection, the target diaphragm 23 is deflected while neighboring diaphragms 23 are not deflected, causing the partitions 22*a* positioned between the target diaphragm 23 and neighboring diaphragms 23 to tilt into the target pressure chamber 22. Since displacement of the diaphragm 23 caused by tilting of the partitions 22*a* is greater during single-channel ejection than during multichannel ejection, overall displacement of the diaphragm 23 during single-channel ejection is greater than overall displacement during multichannel ejection due to the amount of displacement caused by tilting of the partitions 22*a*.

However, when the diaphragm 23 is placed in a flat orientation for the first state during standby periods, partitions 22*a* are less prone to tilt into the target pressure chamber 22 during single-channel ejection, thereby reducing displacement of the diaphragm 23 caused by tilting of the partitions 22*a*. Hence, displacement of the diaphragm 23 during single-channel ejection is equivalent to displacement of the diaphragm 23 during multichannel ejection, thereby achieving a displacement ratio of 100% for the diaphragm 23 with no variation in displacement of the diaphragm 23 caused by crosstalk. As a result, the velocity of ink droplets ejected from the nozzles 21 does not fluctuate, suppressing a decline in image quality.

The diaphragm 23 is also displaced by deformation of the piezoelectric element 24 when a voltage is applied to the piezoelectric element 24. Hence, the diaphragm 23 can be set to a flat orientation in the first state through simple voltage control, suppressing variations in displacement of the diaphragm 23 caused by crosstalk.

Further, the partitions 22*a* tend to be made very thin in an inkjet printer 10 having a resolution of 300 dpi or greater. However, tilting of the partitions 22*a* is reduced by setting the diaphragms 23 to a flat orientation, thereby suppressing variation in the displacement of diaphragms 23 caused by crosstalk.

In addition, the thickness of the partitions 22*a* can be increased to reduce the tendency of the partitions 22*a* to tilt. However, increasing the partition thickness either requires smaller pressure chambers 22, which can lead to ink ejection problems, or necessitates an increase in the size of the device. However, since tilting of partitions 22*a* can be reduced by keeping the diaphragms 23 in a flat state, it is not necessary to increase the thickness of the partitions 22*a*, thereby avoiding ink ejection problems or an increase in the size of the device.

Since tilting of the partitions 22*a* is reduced by setting the diaphragms 23 in a flat orientation, it is not necessary to increase the thickness of the partitions 22*a* to reduce their tilting. Thus, the configuration of the present invention can avoid ink ejection problems and the problem of an increase in the size of the device caused by increasing the thickness of the partitions 22*a*.

When this diaphragm 23 is in its flat orientation, the diaphragm 23 of a neighboring pressure chamber 22 is unlikely to be affected. Therefore, this configuration suppresses the influence of crosstalk on the displacement of diaphragms.

Further, the diaphragm 23 can be kept flat in the first state through simple voltage control, suppressing variations in the displacement of diaphragms caused by crosstalk.

Second Embodiment

In the inkjet printer 10 according to a second embodiment, the flat orientation of the diaphragm 23 in the first state includes not only a perfectly flat state, but also a state in which the diaphragm 23 is slightly deflected. Specifically, the flat orientation of the diaphragm 23 in the first state includes a condition in which the deflection ratio of the diaphragm 23 is within ±0.7%. If the deflection ratio of the diaphragm 23 is within ±0.7%, the difference in the displacement ratio of the diaphragm 23 from the displacement ratio of a completely flat diaphragm 23 can be kept within ±10%, as illustrated in FIG. 7. Since the displacement of the diaphragm 23 during single-channel ejection is approximately the same as displacement of the diaphragm 23 during multichannel ejection in this case, this configuration can suppress variation in displacement of the diaphragms 23 caused by crosstalk, thereby reducing a decline in image quality.

Third Embodiment

In the inkjet printer 10 according to a third embodiment, the flat orientation of the diaphragm 23 in the first state includes not only a perfectly flat state, but also a state in which the diaphragm 23 is slightly deflected toward the piezoelectric element 24 side. Specifically, the flat orientation of the diaphragm 23 in the first state includes a condition in which the deflection ratio of the diaphragm 23 is at least 0% and no greater than +0.7%. When the deflection ratio of the diaphragm 23 is 0%, the diaphragm 23 is in a perfectly flat orientation. When the deflection ratio of the diaphragm 23 is greater than 0% but no greater than +0.7%, the diaphragm 23 is in a condition slightly deflected toward the piezoelectric element 24 side.

In this case, the second state is the state in which the diaphragm 23 is displaced to the piezoelectric element 24 side so that the volume of the pressure chamber 22 covered by the diaphragm 23 is greater than the prescribed volume. When transitioning from the second state to the first state, the diaphragm 23 is displaced from the second state in which the diaphragm 23 is deflected toward the piezoelectric element 24 side to the first state in which the diaphragm 23 is flat or less deflected than in the second state. Hence, the distance in which the diaphragm 23 is displaced from the second state deflected toward the piezoelectric element 24 side to the first state less deflected toward the piezoelectric element 24 side is shorter than the distance in which the diaphragm 23 is displaced from the second state deflected toward the piezoelectric element 24 side to a flat state. This difference increases the velocity of ink ejected by displacement of the diaphragm 23. Hence, the impact position of the ink droplet is not the impact position when the diaphragm 23 is in a perfectly flat state (the prescribed position), but is closer to the previous impact position than the prescribed position. Accordingly, no gap is formed between the current impact position and preceding impact position, resulting in no unprinted areas and suppressing a decline in image quality.

Fourth Embodiment

Figure 8:
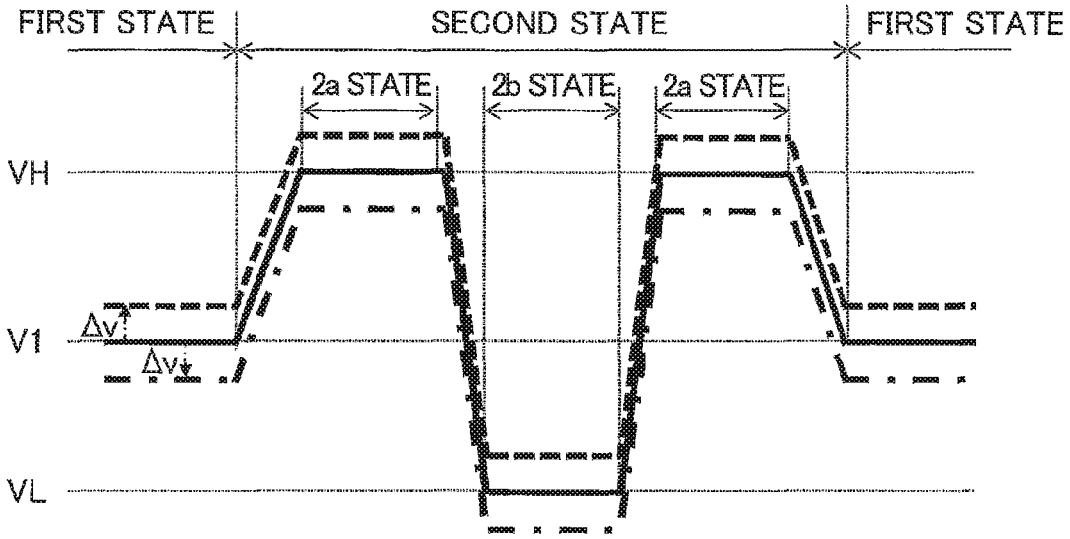
FIG. 8 is a graph illustrating voltage applied to a piezoelectric element of an inkjet recording apparatus according to fourth and eighth embodiments.

In the inkjet printer 10 according to a fourth embodiment, the control unit 18 varies the second voltage applied to the piezoelectric element 24 in the sequence of a high voltage VH, a low voltage VL, and the high voltage VH, as illustrated in FIG. 8. The second voltage is the voltage applied to the piezoelectric element 24 during the second state. The high voltage VH is a higher voltage than the first voltage V1, while the low voltage VL is a lower voltage than the first voltage V1. The first voltage V1 is the voltage applied to the piezoelectric element 24 during the first state.

In this case, the diaphragm 23 is displaced such that the pressure chamber 22 in the second state changes in sequence from a 2*a* state to a 2*b* state and back to the 2*a* state. The 2*a* state is the state in which the pressure chamber 22 has a smaller volume than the prescribed volume due to the high voltage VH applied to the piezoelectric element 24, and the 2*b* state is the state in which the pressure chamber 22 has a larger volume than the prescribed value due to the low voltage VL applied to the piezoelectric element 24. It is preferable that the distance (displacement) in which the diaphragm 23 is displaced to the pressure chamber 22 side by the high voltage VH is equivalent to the distance (displacement) in which the diaphragm 23 is displaced to the piezoelectric element 24 side by the low voltage VL.

Thus, the first voltage V1 is applied to the piezoelectric element 24 during a standby period of a printing operation so that the diaphragm 23 is in the flat orientation shown in FIG. 6A. Consequently, the pressure chamber 22 covered by the diaphragm 23 is in the first state having the prescribed volume.

During an ejection period in which a drive signal is outputted for ejecting an ink droplet, the control unit 18 first applies the high voltage VH to the piezoelectric element 24, causing the diaphragm 23 to deflect toward the pressure chamber 22 side, as shown in FIG. 6C. Consequently, the pressure chamber 22 covered by the diaphragm 23 transitions from the first state to the 2*a* state. Since the volume of the pressure chamber 22 in the 2*a* state is smaller than the volume in the first state, pressure is applied to ink accommodated in the pressure chamber 22. However, since the rise time for transitioning from the first voltage V1 to the high voltage VH is long, the pressure applied to the ink is smaller than the pressure required to eject an ink droplet from the nozzle 21. Therefore, ink is not ejected at this time.

Subsequently, the control unit 18 applies the low voltage VL to the piezoelectric element 24, causing the diaphragm 23 to deflect toward the piezoelectric element 24 side, as illustrated in FIG. 6B. Consequently, the pressure chamber 22 enters the 2*b* state in which its volume is greater than that in the 2*a* state. At this time, ink flows into the pressure chamber 22 from the manifold 29, filling the pressure chamber 22 with ink.

Next, the control unit 18 again applies the high voltage VH to the piezoelectric element 24, causing the diaphragm 23 to deflect toward the pressure chamber 22 side, as shown in FIG. 6C. When the pressure chamber 22 changes from the 2*b* state to the 2*a* state, pressure is applied to the ink accommodated in the pressure chamber 22. However, in this case the rise time for transitioning from the low voltage VL to the high voltage VH is short, applying pressure greater than that required to eject ink from the nozzle 21 to the ink in the pressure chamber 22. Hence, ink is ejected.

In the standby period following ink ejection, the control unit 18 returns the voltage applied to the piezoelectric element 24 to the first voltage V1. Consequently, the diaphragm 23 is returned to its flat orientation and the pressure chamber 22 to its first state, as illustrated in FIG. 6A.

Through this method, the diaphragm 23 in the second state first deflects toward the piezoelectric element 24 side and then deflects toward the pressure chamber 22 side to eject ink, and subsequently returns to its flat orientation in the first state for the standby period. Thus, since the diaphragm 23 is displaced toward both the pressure chamber 22 side and the piezoelectric element 24 side during ink ejection, the diaphragm 23 can be set to a flat orientation during the standby period. This method can reduce variation in displacement of the diaphragm 23 caused by crosstalk, thereby reducing the decline in image quality.

Further, the amount of displacement of the diaphragm 23 in response to applied voltage (displacement efficiency) is lessened when the diaphragm 23 is displaced more than a certain amount. Therefore, the displacement efficiency of a greatly displaced diaphragm 23 is lower when the diaphragm 23 is displaced more toward either the piezoelectric element 24 side or the pressure chamber 22 side than toward the other side. However, by displacing the diaphragm 23 toward both the pressure chamber 22 side and the piezoelectric element 24 side, it is possible to avoid a large displacement of the diaphragm 23, thereby suppressing a drop in the displacement efficiency of the diaphragm 23.

Further, by setting the displacement of the diaphragm 23 toward the pressure chamber 22 side equivalent to the displacement of the diaphragm 23 toward the piezoelectric element 24 side, the diaphragm 23 can be displaced equally toward both the pressure chamber 22 side and piezoelectric element 24 side. In this case, the diaphragm 23 can be maintained in a flatter orientation during standby periods, thereby better suppressing a drop in the displacement efficiency of the diaphragm 23.

Fifth Embodiment

Figure 9:
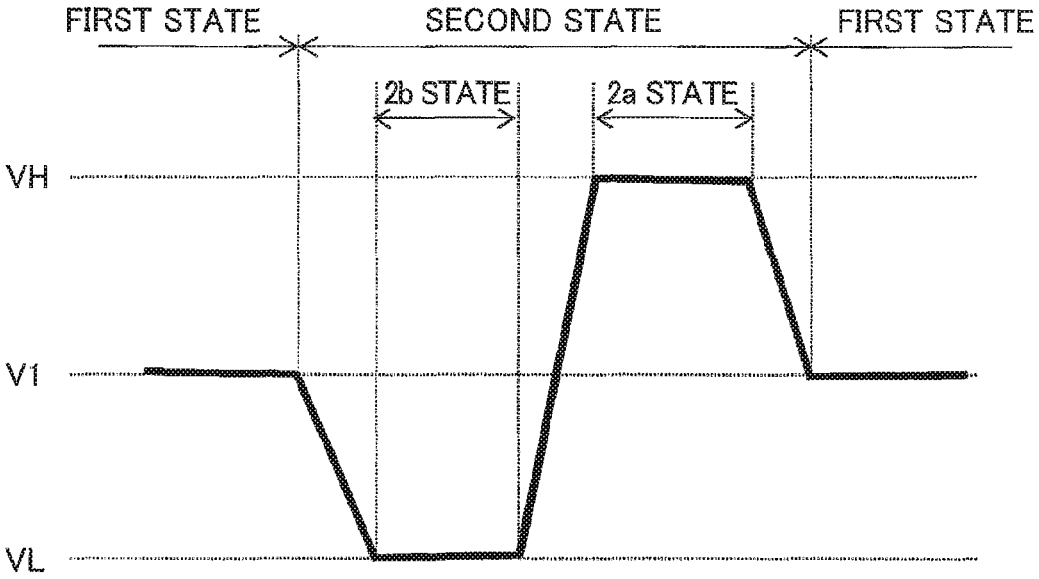
FIG. 9 is a graph illustrating voltage applied to a piezoelectric element of an inkjet recording apparatus according to a fifth embodiment.

In the inkjet printer 10 according to a fifth embodiment, the control unit 18 varies the second voltage applied to the piezoelectric element 24 in the sequence of a low voltage VL and a high voltage VH, as illustrated in FIG. 9.

In this case, the diaphragm 23 is displaced so that the pressure chamber 22 in its second state changes in sequence to a 2*b* state and a 2*a* state. It is preferable that the amount of displacement of the diaphragm 23 toward the pressure chamber 22 side caused by the high voltage VH is equivalent to the amount of displacement of the diaphragm 23 toward the piezoelectric element 24 side caused by the low voltage VL.

During standby periods in the printing operation, the control unit 18 applies the first voltage V1 to the piezoelectric element 24 so that the diaphragm 23 is in a flat orientation, as in the example of FIG. 6A. Consequently, the pressure chamber 22 covered by the diaphragm 23 is kept in the first state.

During ejection, the control unit 18 applies the low voltage VL to the piezoelectric element 24, deflecting the diaphragm 23 toward the piezoelectric element 24 side, as illustrated in FIG. 6B. Consequently, the pressure chamber 22 shifts to the 2*b* state in which its volume is greater than that in the first state. In this state, ink flows into the pressure chamber 22 from the manifold 29 (see FIG. 3), filling the pressure chamber 22 with ink.

Next, the control unit 18 applies the high voltage VH to the piezoelectric element 24, deflecting the diaphragm 23 toward the pressure chamber 22 side, as illustrated in FIG. 6C. As a result, the pressure chamber 22 shifts from the 2*b* state to the 2*a* state, applying pressure to the ink accommodated in the pressure chamber 22. Since the rise time for transitioning from the low voltage VL to the high voltage VH is short, a pressure greater than the pressure required for rejecting ink from the nozzle 21 is applied to the ink, effecting ink ejection.

In the standby period following ink ejection, the control unit 18 again applies the first voltage V1 to the piezoelectric element 24, returning the diaphragm 23 to its flat orientation and the pressure chamber 22 to the first state.

With the method described above, the diaphragm 23 is displaced toward both the pressure chamber 22 side and the piezoelectric element 24 side during ink ejection. Thus, by maintaining the diaphragm 23 in a flat orientation during standby periods, it is possible to reduce variation in the displacement of the diaphragm 23 caused by crosstalk, reducing a decline in image quality. Further, this method can suppress a decline in the displacement efficiency of the diaphragm 23.

Sixth Embodiment

In some cases, the diaphragm 23 may not form a flat orientation when the first voltage V1 is applied to the piezoelectric element 24 due to product variation or aging, for example. In such cases, the first voltage V1 may be adjusted so that the diaphragm 23 attains a flat orientation. The inkjet printer 10 according to a sixth embodiment is further provided with a scanning unit 19 that reads images formed in ink ejected from the nozzles 21. The control unit 18 adjusts the first voltage V1 so that the diaphragm 23 attains a flat orientation based on ink impact positions identified in an image read by the scanning unit 19.

As an example, the scanning unit 19 is provided above the print head 20, as illustrated in FIG. 1, and is connected to the control unit 18. The scanning unit 19 optically reads the image as image data and outputs this image data to the control unit 18.

Next, the control unit 18 identifies the positions of dots constituting the image from the image data as the ink impact positions. An ink impact position is dependent on the velocity of ink ejection, and the ejection velocity is dependent on the position of the diaphragm 23 during the standby period. The position of the diaphragm 23 is adjusted by changing the voltage applied to the piezoelectric element 24. Accordingly, the control unit 18 adjusts the first voltage V1 based on these ink impact positions so that the diaphragm 23 attains a flat orientation. The relationships between ink impact positions and voltages applied to the piezoelectric element 24 may be found in advance through experimentation or simulation, for example.

Take the case of an inkjet printer 10 that ejects ink by first displacing the diaphragm 23 toward the piezoelectric element 24 side and subsequently displacing the diaphragm 23 toward the pressure chamber 22. When the diaphragm 23 in its first state is already deflected from its flat orientation toward the piezoelectric element 24 side, the initial displacement of the diaphragm 23 is reduced by this amount of deflection, thereby increasing ink ejection velocity and narrowing the gap between neighboring ink impact positions from that formed when the diaphragm 23 has a flat orientation in the first state. Here, the control unit 18 acquires the voltage corresponding to the gap between neighboring ink impact positions and adjusts the first voltage V1 to widen this gap based on this voltage. In this way, the control unit 18 adjusts the first voltage V1 so that the ink impact positions match the impact positions formed when the diaphragm 23 is flat in its first state (prescribed positions). Hence, the diaphragm 23 is displaced toward the pressure chamber 22 side to attain a flat orientation.

As described above, ink impact positions sometimes deviate from their prescribed positions when the diaphragm 23 in its first state varies from a flat orientation. In such cases, it is possible to return the diaphragm 23 to a flat orientation in its first state by adjusting the first voltage V1 so that the impact positions match the prescribed positions, thereby reducing a decline in image quality caused by crosstalk.

Note that the inkjet printer 10 need not be provided with the scanning unit 19 as described in the above embodiment. When the inkjet printer 10 is not provided with a scanning unit 19, the control unit 18 may acquire image data from a scanner, camera, or the like connected to the inkjet printer 10, measure impact positions of ejected ink droplets based on the image data, and adjust the first voltage V1 so that the impact positions match impact positions achieved when the diaphragm 23 is in a flat orientation.

Seventh Embodiment

In the inkjet printer 10 according to a seventh embodiment, the control unit 18 adjusts the first voltage V1 if the diaphragm 23 is not in a flat orientation when the first voltage V1 is applied to the piezoelectric element 24. In this case, a distance sensor is used to measure the distance to the diaphragm 23 in its first state, and the control unit 18 adjusts the first voltage V1 so that the measured distance is equal to the distance when the diaphragm 23 is in a flat orientation (prescribed distance).

Here, the distance sensor may be used to measure the distance to the diaphragm 23 in its first state as a manufacturing step for the inkjet printer 10, for example. Further, the control unit 18 acquires in advance the distance from the distance sensor to the diaphragm 23 in its flat orientation (the prescribed distance). Based on this information, the control unit 18 adjusts the first voltage V1 so that the measured distance matches the prescribed distance.

As described above, the diaphragm 23 may deviate from its flat orientation in the first state, resulting in the distance from the distance sensor to the diaphragm 23 deviating from the prescribed distance. However, by adjusting the first voltage V1 so that the distance to the diaphragm 23 is equivalent to the prescribed distance, the control unit 18 can return the diaphragm 23 to a flat orientation for its first state, thereby reducing a decline in image quality caused by crosstalk.

Eighth Embodiment

In the inkjet printer 10 according to an eighth embodiment, the control unit 18 modifies the second voltage based on change in the first voltage V1 when the first voltage V1 is modified to adjust the diaphragm 23 to its flat orientation.

For example, if the first voltage V1 was modified by Δv in order to place the diaphragm 23 in a flat orientation in its first state, the control unit 18 changes the second voltage by Δv. When the first voltage V1 is raised by Δv as in the example of FIG. 8, the control unit 18 also raises the high voltage VH, low voltage VL, and high voltage VH of the second voltage by Δv. Conversely, if the first voltage V1 is decreased by Δv, the control unit 18 decreases the high voltage VH, low voltage VL, and high voltage VH of the second voltage by Δv.

If the second voltage is decreased, as in this example, the control unit 18 adjusts the first voltage V1 so that the voltage lower than the first voltage V1 (the low voltage VL) is no lower than the voltage corresponding to the coercive field of the piezoelectric element 24. This procedure prevents depolarization of the piezoelectric element 24.

In this way, the control unit 18 can displace the diaphragm 23 in its second state equally to both the pressure chamber 22 side and the piezoelectric element 24 side. Accordingly, this method can reduce a drop in image quality caused by crosstalk while suppressing a decline in the displacement efficiency of the diaphragm 23.

Note that the control unit 18 need not modify the second voltage in response to an adjustment to the first voltage V1. This method can also reduce a decline in image quality caused by crosstalk since the diaphragm 23 is kept in a flat orientation in its first state.

Ninth Embodiment

In the inkjet printer 10 according to a ninth embodiment, in order to adjust the first voltage V1 so that the diaphragm 23 attains a flat orientation in the first state, the control unit 18 selects a first voltage V1 from among a plurality of voltage options so that the deflection ratio of the diaphragm 23 is either zero (0) or as close to zero (0) as possible. The deflection ratio of the diaphragm 23 is the amount of deflection in the diaphragm 23 when the diaphragm 23 is in the first state to the width of the pressure chamber 22 along the aligned direction of the pressure chambers 22.

In some cases the first voltage V1 cannot be set to any arbitrary value, but must be set to one of a plurality of predetermined values provided as candidates for the first voltage V1. In such cases, the voltage selected as the first voltage V1 must be the voltage that produces a deflection in the diaphragm 23 of zero (0) or as close as possible to zero (0) when adjusting the first voltage V1 so that the diaphragm 23 is in a flat orientation in its first state.

Through this adjustment method, the control unit 18 selects the first voltage V1 that produces a deflection in the diaphragm 23 of zero (0) or as close as possible to zero (0) from among a plurality of predetermined voltage selections. Accordingly, this method can set the diaphragm 23 to a flat orientation in its first state, thereby reducing a decline in image quality caused by crosstalk.

Note that even when the first voltage V1 is applied to the piezoelectric element 24 in the first state and the v2 is applied to the piezoelectric element 24 in the second state, in the first through third embodiments described above it is still possible to adjust the first voltage V1 so that the diaphragm 23 attains a flat orientation in the first state, as in the sixth and seventh embodiments described above. When performing this adjustment, the control unit 18 may also modify the second voltage based on the change in the first voltage V1, as described in the eighth embodiment. In this case, the control unit 18 may adjust the first voltage V1 so that the voltage lower than the first voltage V1 is no less than the voltage corresponding to the coercive field of the piezoelectric element 24. Further, the control unit 18 may select the first voltage V1 from among a plurality of voltage options so that deflection of the diaphragm 23 relative to the width of the pressure chamber 22 along the aligned direction of the pressure chambers 22 is zero (0) or as close as possible to zero (0).

While the description has been made in detail with reference to specific embodiments thereof, it would be apparent to those skilled in the art that various changes and modifications may be made therein without departing from the spirit and scope of the above described embodiments.

What is claimed is:

1. An inkjet printer comprising:

a plurality of nozzles;

a plurality of pressure chambers in fluid communication with respective ones of the plurality of nozzles individually, and having a width in a direction where the plurality of pressure chambers are arrayed;

a plurality of diaphragms attached to respective ones of the plurality of pressure chambers individually, each of the plurality of diaphragms being deflected between a first state in which a corresponding pressure chamber has a first volume and a second state in which the corresponding pressure chamber has a second volume different from the first volume, the diaphragm, which is flat in the first state, having a deflection ratio falling within a range from −0.7% to +0.7%, where the deflection ratio is defined by dividing a deflected amount of the diaphragm by the width of the corresponding pressure chamber, and where a direction in which the diaphragm deflects such that a volume of the corresponding pressure chamber increases is set to positive whereas a direction in which the diaphragm deflects such that a volume of the corresponding pressure chamber decreases is set to negative in the deflection ratio;

a plurality of piezoelectric elements attached to respective ones of the plurality of diaphragms individually, each of the plurality of piezoelectric elements being configured to deflect a corresponding diaphragm in response to a voltage applied to the each of the plurality of piezoelectric elements; and a controller configured to control voltage application to each of the plurality of piezoelectric elements, when a diaphragm is in the first state the controller applying a first voltage so that the diaphragm is substantially flat, and when the diaphragm is in the second state the controller applying a second voltage, the controller being configured to control the voltage such that a pressure chamber ejects an ink droplet from the corresponding nozzle in response to the deflection of the diaphragm reverting from the second state to the first state.

2. The inkjet printer according to claim 1, wherein flatness of the diaphragm preferably falls within a range from 0% to +0.7% in the deflection ratio.

3. An inkjet printer comprising:

a plurality of nozzles;

a plurality of pressure chambers in fluid communication with respective ones of the plurality of nozzles individually;

a plurality of diaphragms attached to respective ones of the plurality of pressure chambers individually, each of the plurality of diaphragms being deflected between a first state in which a corresponding pressure chamber has a first volume and a second state in which the corresponding pressure chamber has a second volume different from the first volume;

a plurality of piezoelectric elements attached to respective ones of the plurality of diaphragms individually, each of the plurality of piezoelectric elements being configured to deflect a corresponding diaphragm in response to a voltage applied to the each of the plurality of piezoelectric elements, the each of the plurality of piezoelectric elements having a coercive field; and a controller configured to control voltage application to each of the plurality of piezoelectric elements, when a diaphragm is in the first state the controller applying a first voltage so that the diaphragm is substantially flat, and when the diaphragm is in the second state the controller applying a second voltage, the controller being configured to control the voltage such that a pressure chamber ejects an ink droplet from the corresponding nozzle in response to the deflection of the diaphragm reverting from the second state to the first state, the controller configured to control the first voltage such that the second voltage is greater than the coercive field of the piezoelectric element and configured to change the second voltage in accordance with a change of the first voltage.

4. An inkjet printer comprising:

a plurality of nozzles;

a plurality of pressure chambers in fluid communication with respective ones of the plurality of nozzles individually;

a plurality of diaphragms attached to respective ones of the plurality of pressure chambers individually, each of the plurality of diaphragms being deflected between a first state in which a corresponding pressure chamber has a first volume and a second state in which the corresponding pressure chamber has a second volume different from the first volume;

a plurality of piezoelectric elements attached to respective ones of the plurality of diaphragms individually, each of the plurality of piezoelectric elements being configured to deflect a corresponding diaphragm in response to a voltage applied to the each of the plurality of piezoelectric elements; and a controller configured to control voltage application to each of the plurality of piezoelectric elements, when a diaphragm is in the first state the controller applying a first voltage so that the diaphragm is substantially flat, and when the diaphragm is in the second state the controller applying a second voltage, the controller being configured to control the voltage such that a pressure chamber ejects an ink droplet from the corresponding nozzle in response to the deflection of the diaphragm reverting from the second state to the first state, the controller being further configured to change the second voltage from a higher voltage higher than the first voltage to a lower voltage lower than the first voltage, and then to change the second voltage to the higher voltage, the second volume being smaller than the first volume when the second voltage is the higher voltage, and greater than the first volume when the second voltage is the lower voltage.

5. An inkjet printer comprising:

a plurality of nozzles;

a plurality of pressure chambers in fluid communication with respective ones of the plurality of nozzles individually;

a plurality of diaphragms attached to respective ones of the plurality of pressure chambers individually, each of the plurality of diaphragms being deflected between a first state in which a corresponding pressure chamber has a first volume and a second state in which the corresponding pressure chamber has a second volume different from the first volume;

a plurality of piezoelectric elements attached to respective ones of the plurality of diaphragms individually, each of the plurality of piezoelectric elements being configured to deflect a corresponding diaphragm in response to a voltage applied to the each of the plurality of piezoelectric elements; and a controller configured to control voltage application to each of the plurality of piezoelectric elements, when a diaphragm is in the first state the controller applying a first voltage so that the diaphragm is substantially flat, and when the diaphragm is in the second state the controller applying a second voltage, the controller being configured to control the voltage such that a pressure chamber ejects an ink droplet from the corresponding nozzle in response to the deflection of the diaphragm reverting from the second state to the first state, the controller being further configured to change the second voltage from a lower voltage lower than the first voltage to a higher voltage higher than the first voltage, the second volume being smaller than the first volume when the second voltage is the higher voltage, and greater than the first volume when the second voltage is the lower voltage.

6. The inkjet printer according to claim 3, further comprising a scanner unit configured to measure an impact position of an ink droplet ejected from the plurality of nozzles, wherein, based on the impact position of the ink droplet, the controller is further configured to control the first voltage so that the diaphragm is flattened.

7. The inkjet printer according to claim 1, wherein the plurality of nozzles are arranged in a row such that an image formed by the ejected ink droplets has a resolution of at least 300 dpi.

8. An adjusting method for an inkjet printer comprising:

a nozzle;

a pressure chamber in fluid communication with the nozzle;

a diaphragm attached to the pressure chamber, the diaphragm being deflected between a first state in which the pressure chamber has a first volume and a second state in which the pressure chamber has a second volume different from the first volume; and a piezoelectric element attached to the diaphragm, the piezoelectric element being configured to deflect the diaphragm in response to a voltage applied to the piezoelectric element;

the adjusting method comprising:

applying, to the piezoelectric element, a first voltage such that the pressure chamber has the first volume;

changing the voltage applied to the piezoelectric element from the first voltage to a second voltage such that the pressure chamber has the second volume;

changing the voltage applied to the piezoelectric element from the second voltage to the first voltage;

measuring an impact position of ink ejected from the nozzle; and adjusting the first voltage such that the impact position is the same as an impact position which can be achieved by an ink droplet ejected from the pressure chamber with the diaphragm that, when being in the first state, is flattened.

9. An adjusting method for an inkjet printer comprising:

a nozzle;

a pressure chamber in fluid communication with the nozzle;

a diaphragm attached to the pressure chamber, the diaphragm being deflected between a state in which the pressure chamber has a first volume and a state in which the pressure chamber has a second volume different from the first volume; and a piezoelectric element attached to the diaphragm, the piezoelectric element being configured to deflect the diaphragm in response to a voltage applied to the piezoelectric element;

the adjusting method comprising:

applying a first voltage to the piezoelectric element so that the pressure chamber has the first volume;

changing the voltage applied to the piezoelectric element from the first voltage to a second voltage so that the pressure chamber has the second volume different from the first volume;

changing the voltage applied to the piezoelectric element from the second voltage to the first voltage;

measuring a distance from a sensor to the diaphragm; and adjusting the first voltage such that the distance measured by the sensor is the same as a distance from the sensor to the diaphragm that is flattened.

10. The adjusting method for the inkjet printer according to claim 8, wherein the pressure chamber has a width; and wherein the controller selects the first voltage from among a plurality of preset voltages so that the deflection ratio of the diaphragm in the first state is 0% or closest to 0%, where the deflection ratio is defined by dividing a deflected amount of the diaphragm by the width of the pressure chamber.

11. The adjusting method for the inkjet printer according to claim 9, wherein the pressure chamber has a width; and wherein the controller selects the first voltage from among a plurality of preset voltages so that the deflection ratio of the diaphragm in the first state is 0% or closest to 0%, where the deflection ratio is defined by dividing a deflected amount of the diaphragm by the width of the pressure chamber.

12. The inkjet printer according to claim 1, wherein flatness of the diaphragm falls within a range from 0% to −0.7% in the deflection ratio.

13. An inkjet printer comprising:

a plurality of nozzles;

a plurality of pressure chambers in fluid communication with respective ones of the plurality of nozzles individually;

a plurality of diaphragms attached to respective ones of the plurality of pressure chambers individually, each of the plurality of diaphragms being deflected between a first state in which a corresponding pressure chamber has a first volume and a second state in which the corresponding pressure chamber has a second volume different from the first volume;

a plurality of piezoelectric elements attached to respective ones of the plurality of diaphragms individually, each of the plurality of piezoelectric elements being configured to deflect a corresponding diaphragm in response to a voltage applied to the each of the plurality of piezoelectric elements; and a controller configured to control voltage application to each of the plurality of piezoelectric elements, when a diaphragm is in the first state the controller applying a first voltage that is greater or smaller than zero volts so that the diaphragm is substantially flat, and when the diaphragm is in the second state the controller applying a second voltage, the controller being configured to control the voltage application such that a pressure chamber ejects an ink droplet from the corresponding nozzle in response to the deflection of the diaphragm reverting from the second state to the first state.

* * * * *